United States Patent [19]

Swanson et al.

[11] 4,178,673

[45] Dec. 18, 1979

[54] PIPE SNAPPER MACHINE AND METHOD

[75] Inventors: Eugene S. Swanson; Joel M. Winters, both of Rockford, Ill.

[73] Assignee: Rockford Machine Tool Co., Rockford, Ill.

[21] Appl. No.: 924,468

[22] Filed: Jul. 14, 1978

[51] Int. Cl.[2] ..... B23P 11/02; B23P 19/00

[52] U.S. Cl. ..... 29/453; 29/235; 29/819

[58] Field of Search ..... 29/235, 450, 453, 819 X, 29/505, DIG. 23

[56] References Cited

U.S. PATENT DOCUMENTS

| | | | |
|---|---|---|---|
| 1,681,880 | 8/1928 | Schneible | 29/DIG 23 UX |
| 2,866,481 | 12/1958 | Bratsch | 29/453 UX |
| 2,948,324 | 8/1960 | Penrose | 29/819 X |
| 3,154,037 | 10/1964 | Mayrath | 29/505 X |
| 3,173,172 | 3/1965 | Pasquetti | 29/819X |
| 3,250,077 | 5/1966 | Ede | 29/453 |
| 3,300,812 | 1/1967 | Pasquetti | 29/819 X |
| 3,606,670 | 9/1971 | Wienand et al. | 29/453 X |
| 3,650,009 | 3/1972 | Ausnit | 29/235 |
| 3,650,011 | 3/1972 | Ausnit | 29/453 X |

*Primary Examiner*—Charlie T. Moon

*Attorney, Agent, or Firm*—James H. Bower; Mitchell J. Hill

[57] ABSTRACT

A method for assembling sheet metal pipes, and a machine for carrying out the method which comprises assembling a pipe from a preformed pipe blank into a finished pipe without permanently deforming the pipe blank material. The method comprises the steps of folding of a preformed pipe blank, having a male lock joint member along one longitudinal edge and a female lock joint member along the other longitudinal edge so as to move the longitudinal edges toward each other, and then inserting the male lock joint member into the female lock joint member, with the spring tension created in the pipe blank due to the folding action effecting a locking action between the two lock joint members. The pipe snapper machine includes a pair of idler rollers and a pair of drive rollers aligned with the idler rollers for receiving a leading end of a pipe blank and moving the male lock joint member along one longitudinal edge of the blank form into a female lock joint member along the adjacent longitudinal edge of the pipe blank into locking engagement. The machine includes an entrance pipe guide and an exit pipe guide is provided. A power source is provided for driving the drive rollers. The idler rollers effect a vertical pressure on the pipe blank as it is passed therebetween. The drive rollers effect a transverse assembly pressure on the pipe blank as it is passed therebetween.

14 Claims, 14 Drawing Figures

FIG. 5
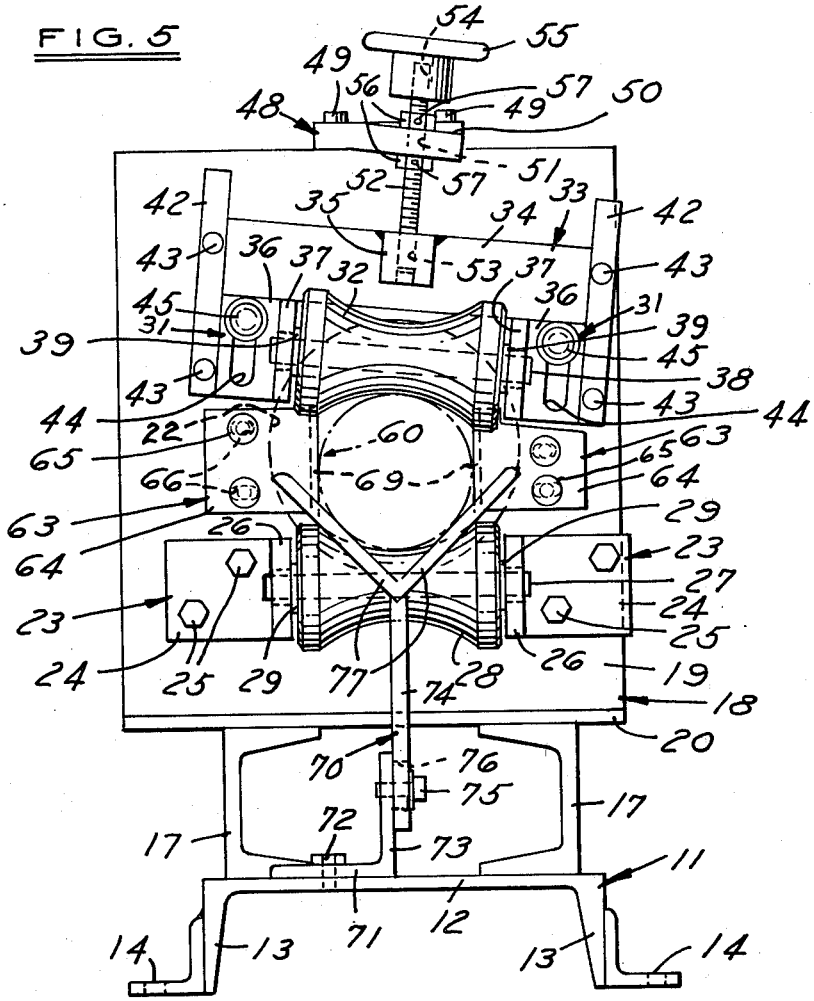
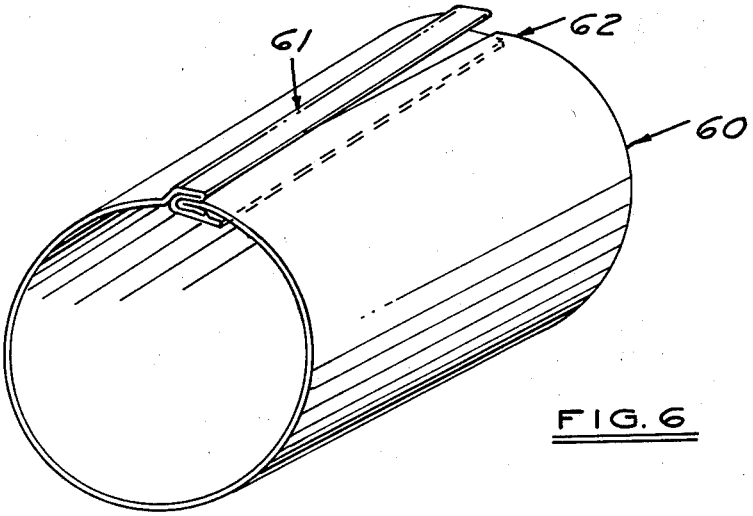
FIG. 6

PIPE SNAPPER MACHINE AND METHOD

BACKGROUND OF THE INVENTION

1. Field of the Invention

This invention relates generally to pipe construction machines for constructing sheet metal tubes or pipes for many purposes, as for example, heating and ventillating conduits. The invention is particularly concerned with a method and machine for assembling a preformed pipe blank into a finished pipe without any deforming of the sheet metal material.

2. Description of the Prior Art

It is known in the pipe fabricating art to provide machines for forming a finished tube or pipe from sheet metal material. Examples of such prior art machines are shown in U.S. Pat. Nos. 766,531, 854,136, 1,428,427, 1,681,880 and 2,845,889. The aforementioned prior art pipe making machines are all directed to form a finished or complete pipe by carrying out a final deforming operation of some sort to secure the edges of the sheet metal material together. A disadvantage of such prior art pipe making machines is that the final pipe or product made by such machines must be shipped in the finished tubular form which takes up more shipping volume than if the pipes could be shipped in blank form and in a stacked arrangement, and then assembled at the point of use.

U.S. Pat. Nos. 3,154,037 and 3,208,140 disclose a method and apparatus for anchoring the seams of lock seam tubing together. However, the machines shown and used in said patents deforms the lock seam material, and it does not merely assemble the ends of a pipe blank together without any deforming of the material. Further examples of prior art pipe jointing apparatuses which form pipe by deforming the sheet material are shown in U.S. Pat. Nos. 628,643 and 2,278,155.

SUMMARY OF THE INVENTION

In accordance with the present invention, a finished pipe is assembled from a preformed sheet metal pipe blank which has a rectangular form, but which has a rounded cross section and is provided with a male lock joint member along one longitudinal edge and a mating female lock joint member along the other longitudinal edge. The method for assembling the pipe blank into a finished pipe comprises the steps of elastically folding the preformed pipe so as to form the longitudinal edges toward each other, and then inserting the male joint member into the female joint member, with the spring tension created in the pipe blank, due to the folding action, effecting a locking action between the two lock joint members.

The pipe snapper machine of the present invention includes a base on which is mounted a vertical support member having a pipe passage formed therethrough. A bottom stationary idler roller is mounted on the front side of said vertical support member, and a top movable idler roller is mounted on the front side of the vertical support member in spaced apart operative relationship with the stationary idler roller, and rotatable on an axis that is canted relative to the axis of rotation of the bottom stationary idler roller.

A pipe guide means is operatively mounted on the base in a position in front of the idler rollers for guiding a pipe between the idler rollers and through the passage in the vertical support member. The idler rollers exert a vertical pressure on the pipe blank as it is moved between the idler rollers. A bottom stationary drive roller is mounted on the rear side of the vertical support member. A top drive roller is movably mounted on the rear side of said vertical support member. The drive rollers engage a pipe blank moved through the passage in the vertical support member and pull the pipe blank through the idler and driven rollers and exert a transverse pressure on the pipe blank to move the male lock member into locking engagement with the female lock member without deforming the sheet material of the pipe blank. An exit pipe guide means is provided on the base adjacent the drive rollers.

Other objects, features and advantages of this invention will be apparent from the following detailed description, appended claims, and the accompanying drawings.

BRIEF DESCRIPTION OF THE DRAWINGS

FIG. 5 is an elevation view of the entrance end of the pipe snapper machine illustrated in FIG. 3, taken along the line 5—5 thereof, and looking in the direction of the arrows.

FIG. 6 is a perspective view of a first pipe structure which may be snapped together by the pipe snapper machine of the present invention.

DESCRIPTION OF THE PREFERRED EMBODIMENT

Figure 1:
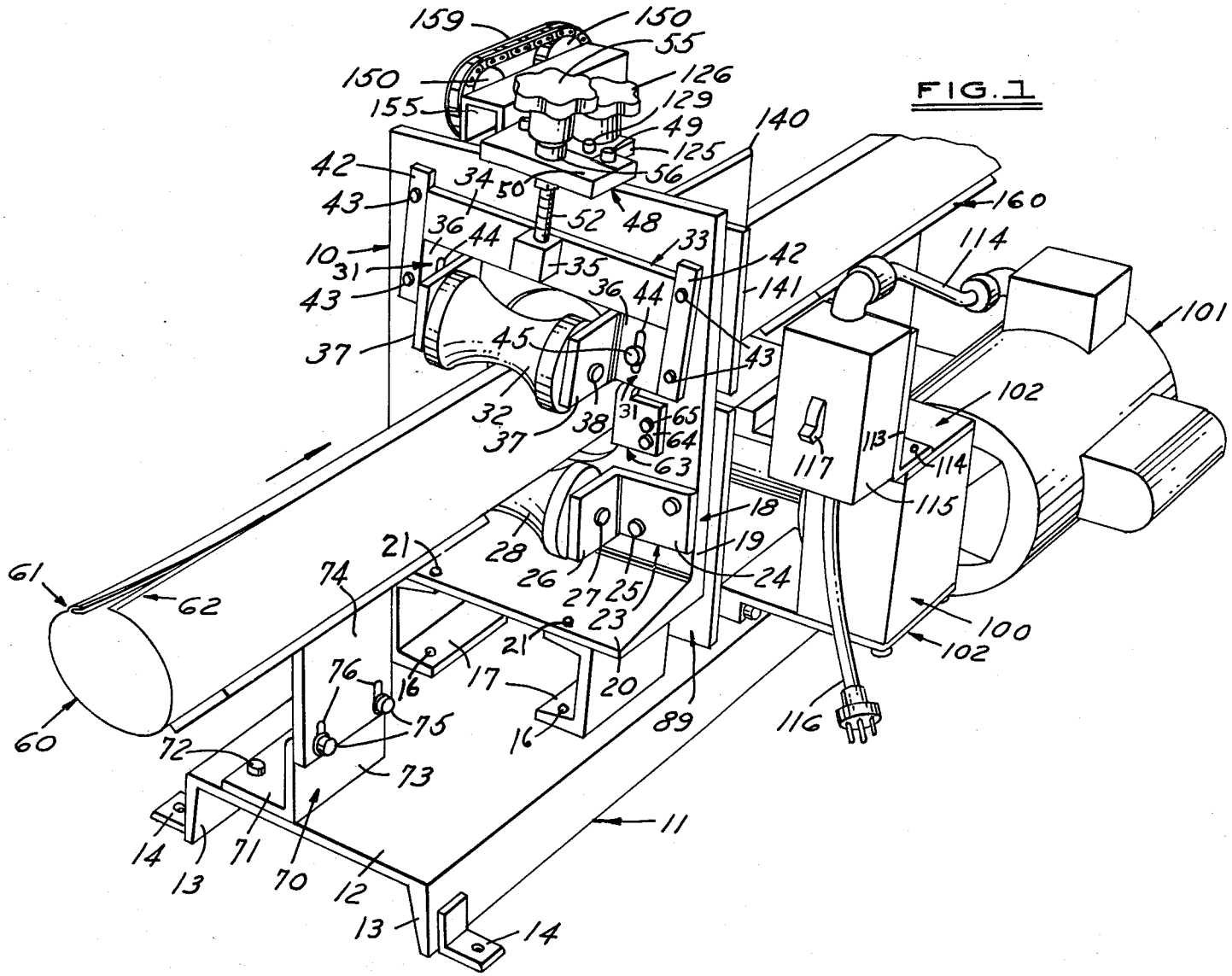
FIG. 1 is an elevation perspective view of a pipe snapper machine made in accordance with the principles of the present invention.
Figure 4:
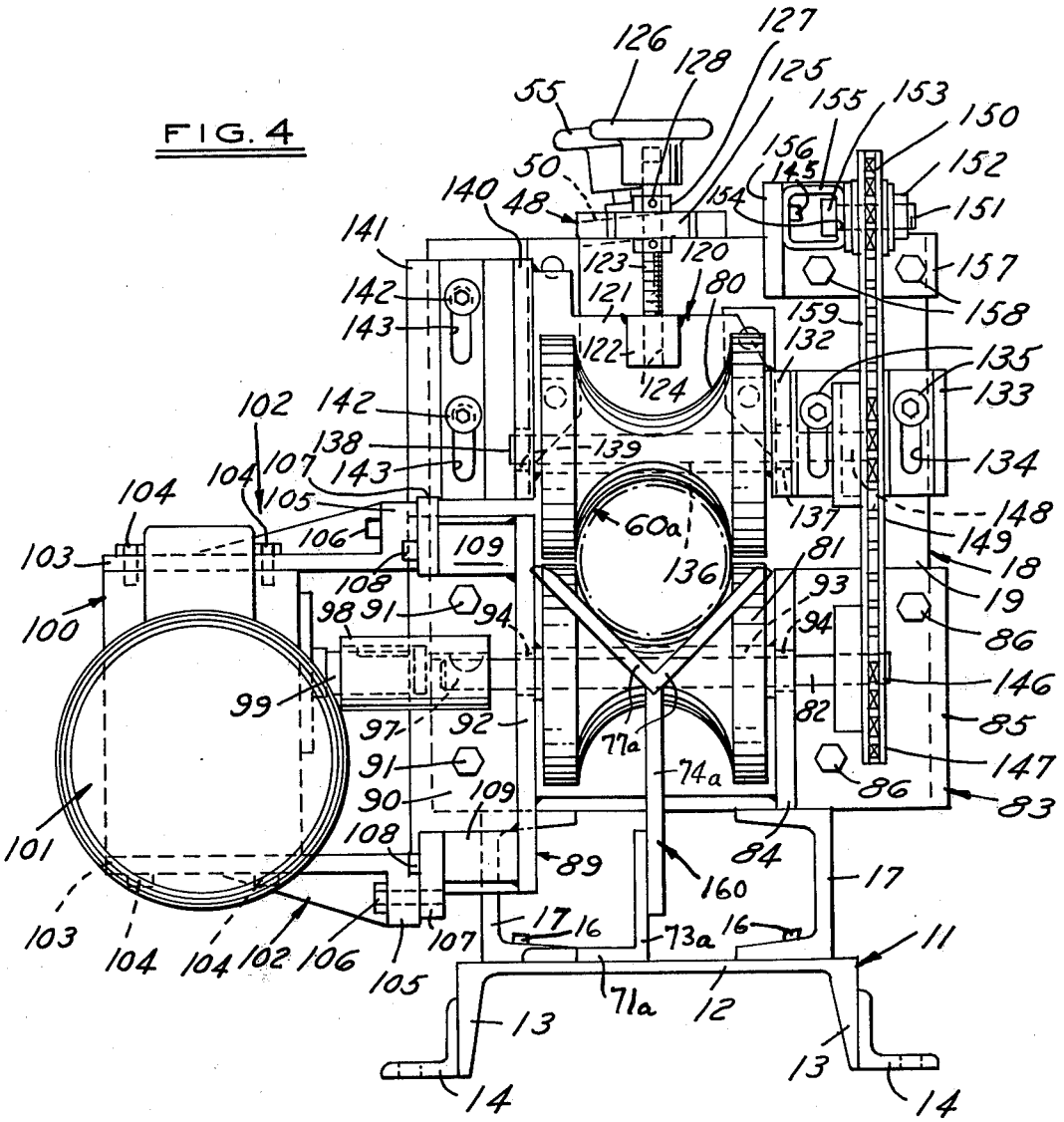
FIG. 4 is an elevation view of the discharge end of the pipe snapper machine illustrated in FIG. 3, taken along the line 4—4 thereof, and looking in the direction of the arrows.

Referring now to the drawings, and in particular to FIG. 1, the numeral 10 generally designates a pipe snapper machine made in accordance with the principles of the present invention. As shown in FIGS. 1 and 4, the pipe snapper machine 10 includes an elongated, channel shaped base, generally indicated by the numeral 11. The base 11 includes a flat top wall 12 with integral longitudinally extended side walls 13. The pipe snapper machine 10 is adapted to be secured on a support surface by any suitable means, as by a plurality of attachment angle clips 14 which are secured to the base side walls 13 by any suitable means, as by welding.

As shown in FIGS. 1, 4 and 5, the pipe snapper machine 10 includes a pair of laterally spaced apart riser members 17 in the form of channel members. The riser members 17 are secured to the top wall 12 of the base 11 by any suitable means, as by suitable machine screws 16. As best seen in FIG. 1, a front roller support angle plate, generally indicated by the numeral 18, is operatively mounted on the top of the two riser members 17. The front roller support angle plate 18 includes a vertical plate 19 and an integral, horizontal flange 20. The vertical plate 19 is provided with a circular pipe passage 22 (FIG. 5). The flange 20 is secured to the riser member 17 by any suitable means, as by a plurality of suitable machine screws 21.

As shown in FIG. 5, the pipe snapper machine 10 is provided at the entrance end thereof with a fixed bottom idler roller 28 and an adjustable top idler roller 32. The bottom idler roller 28 is operatively supported by a pair of laterally spaced apart roller support brackets which are each generally indicated by the numeral 23. Each of the roller support brackets 23 comprise an angle bracket which includes a transverse flange 24 that is secured by suitable machine screws 25 to the front face of the vertical plate 19 of the front roller support angle plate 18. Each of the roller support brackets 23 further includes an integral, longitudinally extended flange 26. The bottom idler roller 28 is rotatably mounted on a suitable shaft 27 which has its ends rollably supported by suitable bearing means in the roller support bracket flanges 26. Suitable washers 29 are mounted between the outer ends of the bottom idler roller 28 and the inner faces of each of the flanges 26.

As shown in FIGS. 1 and 5, the adjustable top idler roller 32 is operatively mounted on a movable top idler roller bracket, generally indicated by the numeral 33. The top idler roller 32 is carried on the roller bracket 33 with its axis of rotation at an angle relative to the axis of rotation of the bottom idler roller 28. The axis of rotation of the top idler roller 32 is canted at an approximate 3° angle relative to the axis of rotation of the bottom idler roller 28. As shown in FIG. 5, the idler rollers 28 and 32 are formed with a concave surface for engagement with an unassembled pipe blank 60 as it is fed into the machine by an operator, as more fully described hereinafter.

As shown in FIGS. 1 and 5, the top idler roller bracket 33 includes a transversely disposed support plate 34 which is slidably mounted on the front face of the vertical plate 19 of the roller support angle plate 18. The support plate 34 is canted on the same angle as the axis of rotation of the top idler roller 32. A block 35, which functions as a screw nut, is fixedly mounted in a central position on the front face of the support plate 34 by any suitable means, as by welding. The support plate 34 is slidably mounted on the front face of the vertical plate 19 of the roller support angle 18. The support plate 34 is slidably mounted between a pair of guide bars 42 which are secured to the front face of the vertical plate 19 by suitable machine screws 43. A pair of roller support angle brackets, generally indicated by the numeral 31, are secured to the lower side of the support plate 34, at the ends thereof, by any suitable means, as by welding. Each of said angle brackets 31 includes a transverse flange 36 which is secured to the lower side of the support plate 34 and an integral longitudinally extended flange 37. The top idler roller 32 is rotatably mounted on a suitable shaft 38 which has its end rotatably supported by suitable bearing means in the flanges 37. As shown in FIG. 5, suitable thrust washers 39 are mounted between the outer ends of the roller 32 and the inner faces of the flanges 37. As best seen in FIG. 5, each of the angle bracket flanges 36 are provided with a vertically extended, elongated slot 44 for the reception of a suitable machine screw 45 for securing the movable idler roller bracket 33 in a desired adjusted position.

The idler roller bracket 33 is moved upwardly and downwardly by the following described structure. As shown in FIG. 5, the screw nut 35 is provided with a threaded bore 53 in which is threadably mounted the lower end of a screw shaft or threaded nut 52. The threaded stud 52 is slidably extended upwardly through a bore 51 into the canted portion 50 of a screw block, generally indicated by the numeral 48. The screw 52 is held against axial movement by a pair of nuts 56 which are held in position on the screw 52 by suitable set screws or pins 57, on opposite sides of the screw block portion 50. The upper end of the screw 52 is threadably mounted in a bore 54 which is formed in the lower end of a suitable hand knob 55. The screw block 48 is seated on the upper end of the vertical plate 19 and it is secured thereto by suitable machine screws 49. It will be seen that when the lock screws 45 are loosened that the top idler roller bracket 33 may be adjusted upwardly and downwardly by rotating the hand knob 55 in the appropriate direction for moving the lower end of the screw 52 inwardly or outwardly of the screw nut 55. After the plate 34 has been moved to a desired position, it is secured in place by the machine screws 45.

As shown in FIGS. 5 and 6, the numeral 60 generally designates an unassembled pipe blank, which in its unassembled or shipping form would comprise either a flat or rounded cross section piece of sheet metal, with a female lock member for a pipe joint, generally indicated by the numeral 61, formed along one longitudinal edge, and a male lock member for a pipe joint, generally indicated by the numeral 62, formed along the other longitudinal edge. The numeral **62*a* in FIG. 2** generally designates an assembled pipe.

Figure 2:
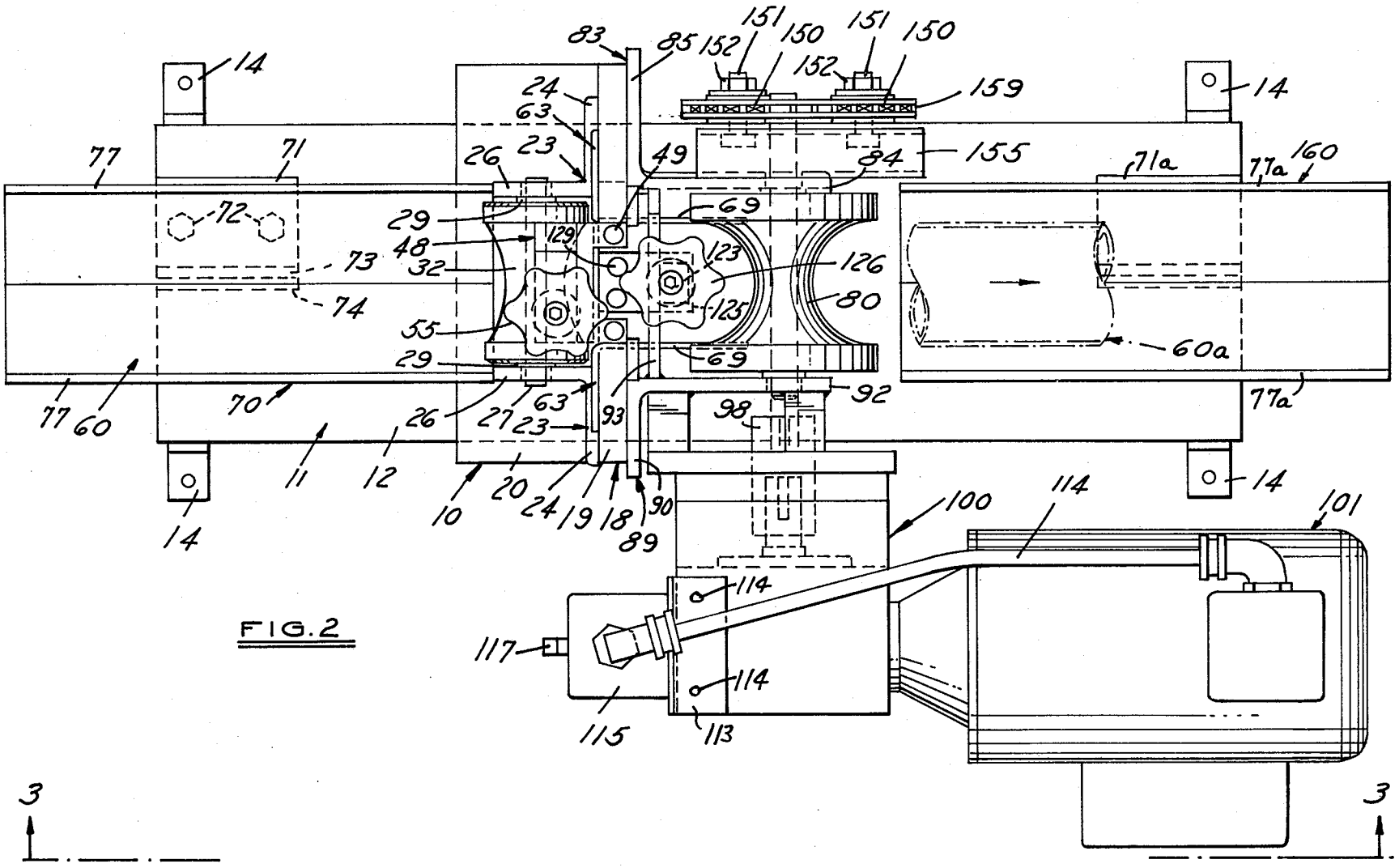
FIG. 2 is a top plan view of the pipe snapper machine illustrated in FIG. 1.

As shown in FIGS. 1 and 2, the pipe snapper machine 10 is provided with a pair of pipe guides or shoes, which are each generally indicated by the numeral 63. The two pipe guides 63 are disposed on opposite sides of the path of travel of a pipe blank 60 through the machine 10. As shown in FIG. 1, each of the pipe guides 63 comprise an angle bracket which includes a transverse flange 64 that is secured by suitable machine screws 65 to the front face of the vertical plate 19. As shown in FIG. 5, each of the pipe guides 63 includes an integral longitudinally extended flange 69 which extends longitudinally to the rear of the vertical plate 19. As shown in FIG. 5, each of the pipe guide flanges 64 is provided with transverse slots 66 through which the machine screws 65 are mounted to permit transverse adjustment of the pipe guides 63, inwardly and outwardly, relative to a pipe blank 60 being actuated therebetween longitudinally through the machine 10.

Figure 3:
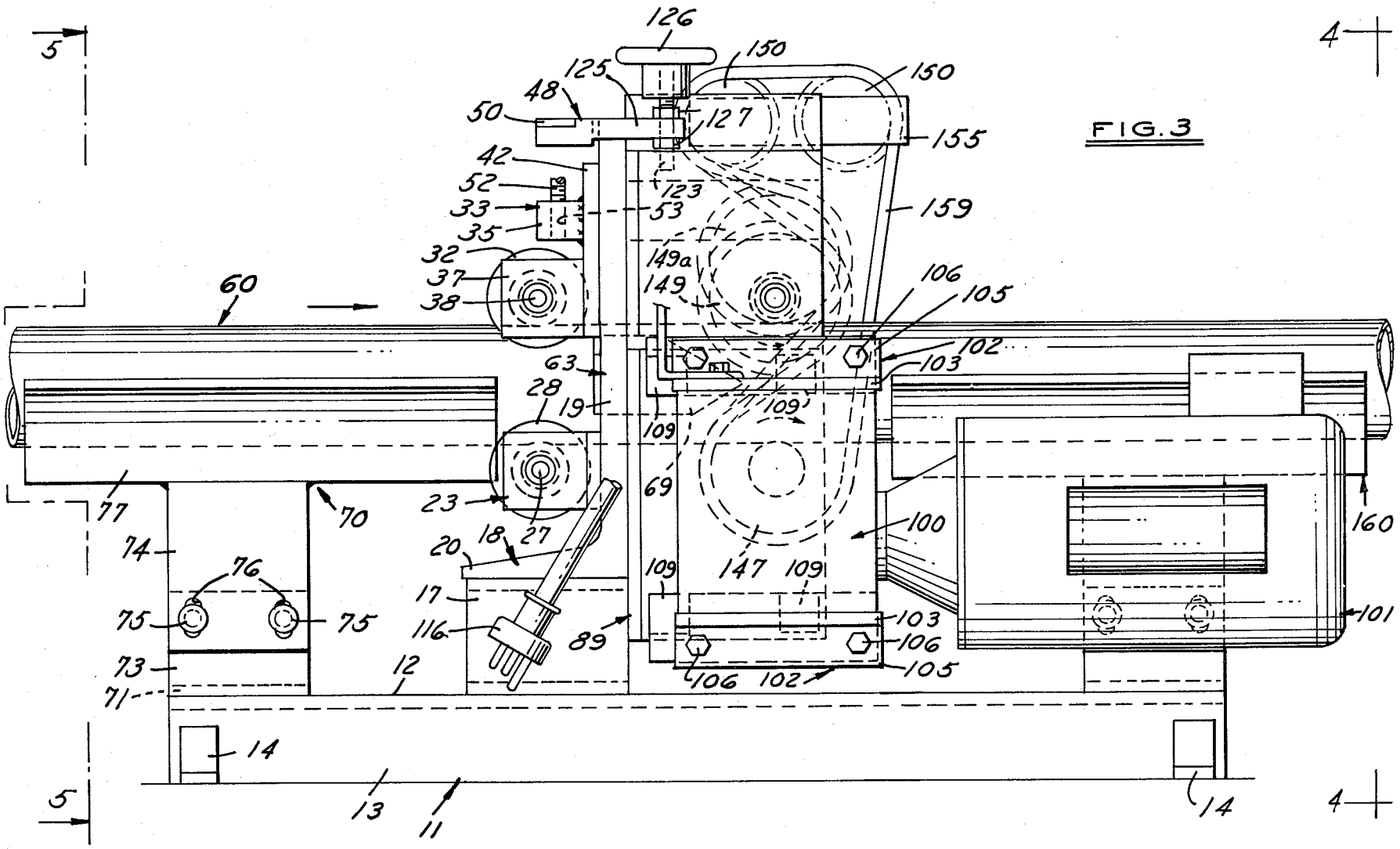
FIG. 3 is a front elevation view of the pipe snapper machine illustrated in FIG. 2, taken along the line 3—3 thereof, and looking in the direction of the arrows.

As shown in FIGS. 1, 3 and 5, the pipe snapper machine 10 is provided with an entrance pipe guide, generally indicated by the numeral 70. The pipe guide 70 includes an attachment angle bracket having a horizontal flange 71 that is secured by suitable machine screws 72 through the top wall 12 of the base 11. Said attachment structure further includes an integral vertical flange 73 which is secured by suitable machine screws 75 to a vertically adjustable support plate 74. As shown in FIG. 1, the support plate 74 is provided with vertically disposed elongated slots 76 for passage therethrough of the machine screws 75 to permit vertical adjustment of the plate 74. As shown in FIG. 5, the entrance pipe guide 70 includes a pair of angled pipe guide plates 77 which are adapted to slidably support an unassembled pipe blank 60 as it is fed between the idler rollers 28 and 32. The guide plates 77 are integrally connected at their lower ends at an angle of approximately 90° relative to each other to form a guide angle bar member. The guide member 77 are attached at their lower ends, as by welding, to the upper end of the adjustable support plate 74.

As shown in FIG. 44, the pipe snapper machine 10 is provided with a pair of drive rollers comprising a top movable drive roller 80 and a stationary bottom drive roller 81. The stationary bottom drive roller 81 is fixedly secured to a horizontal shaft 82 which has the right end, as viewed in FIG. 4, rotatably supported by a suitable shaft support bracket generally indicated by the numeral 83. The shaft support bracket 83 comprises a transverse flange 85 which is secured by suitable machine screws 86 to the rear face of the support vertical plate 19. Integrally formed on the inner end of the transverse flange 85 is a rearwardly and longitudinally extended flange 84 which rotatably supports one end of the shaft 82 by means of a suitable bearing means 94 in a longitudinally and rearwardly extended flange 92 of a second stationary shaft supporting bracket, generally indicated by the numeral 89. The support bracket 89 includes an integral transverse flange 90 which is secured by suitable machine screws 91 to the rear face of the vertical plate 19. As shown in FIGS. 2 and 4, the shaft support brackets 83 and 89 are interconnected by a suitable transverse plate 93 which is attached to said bracket by any suitable means, as by welding.

As shown in FIG. 4, the left end 97 of the shaft 82 is attached by a suitable coupling 98 and appropriate lock key means to the output shaft 99, of a suitable worm gear reduction drive unit, generally indicated by the numeral 100. As shown in FIGS. 1 and 2, the drive unit 100 is connected to and is driven by a suitable electric motor, generally indicated by the numeral 101. As shown in FIGS. 3 and 4, the drive unit 100 is mounted between a pair of brackets, generally indicated by the numeral 102 which each includes a horizontal flange 103 between which is seated the worm gear reduction drive unit 100. The drive unit 100 is attached to the flanges 103 by suitable machine screws 104.

As shown in FIG. 4, the mounting brackets 102 each include an integral vertical flange 105 which is secured by suitable machine screws 106 to a pair of vertically spaced apart, longitudinally disposed plates 107. The plates 107 are secured by suitable machine screws 108 to a pair of vertical spaced apart mounting bars 109 which have their inner ends fixedly secured as by welding to the outer face of the adjacent vertical flange 92 of the shaft support bracket 89. As shown in FIG. 1, the electric motor 101 is connected by a suitable lead wire means 114 to a manually operable switch 117 that is carried in a suitable switch box 115. The switch box 115 is attached to a suitable angle iron bracket 113 which is fixed by suitable screws 114 to the top side of the upper mounting bracket 102. As shown in FIG. 1, the switch 117 is operatively connected to a suitable lead wire and plug means 116 for connection to a suitable source of electrical power.

As shown in FIG. 4, the top drive roller 80 is carried on a movable roller bracket, generally indicated by the numeral 120, which is adapted to be adjusted upwardly and downwardly on the rear face of the vertical plate 19. The top drive roller bracket 120 includes a transverse plate 121 which is slidably mounted on the rear face of the vertical plate 19. A screw block or screw nut 122 is mounted on the rear face of the transverse plate 121, in a central position, and it is secured thereto by any suitable means, as by welding. A screw shaft or threaded nut 123 has its lower end threadably mounted in a threaded bore 124 in the screw block 122. The upper end of the screw shaft 123 is slidably mounted through a suitable bore formed through a screw block 125. The upper end of the screw shaft 123 is threadably mounted in a suitable bore in the lower end of a hand knob 126. The screw shaft 123 is held against axial movement relative to the screw block 125 by a pair of suitable nuts 127 which are secured to the screw shaft 123 by suitable set screws or pins 128. As shown in FIG. 2, the screw block 125 is secured to the top of the vertical plate 19 by suitable machine screws 129.

As shown in FIG. 4, the movable top drive roller 80 is fixedly secured by suitable means to a horizontal shaft 136. The right end of the shaft 136, as viewed in FIG. 4, is rotatably mounted by suitable bearing means 137 in a longitudinally extended vertical flange 132 of an angle bracket that includes an integral transverse flange 133. The transverse flange 133 is provided with a pair of vertically extended, elongated slots 134 which are adapted to receive a pair of machine screws 135 for securing said angle bracket to the vertical plate 19. The last described roller mounting angle bracket comprising the flanges 132 and 133 is fixed to the vertically movable bracket transverse plate 121 by any suitable means, as by welding. The left side of the shaft 136 is indicated by the numeral 138 in FIG. 4, and it is rotatably mounted in a suitable bearing means 139 in a vertical, longitudinally extended flange 140 which is attached, as by welding, to the vertically movable transverse plate 121. A transverse flange 141 is integrally attached to the rear end of the longitudinal flange 140, and it is disposed on the rear face of the vertical plate 19 and secured thereto by suitable machine screws 142. The machine screws 142 are passed through a pair of suitable vertically extended elongated slots 143 which are formed through the flange 141 to permit adjustment of the plate 121 and the attached flange 141 upwardly and downwardly. It will be seen that when the machine screws 135 and 142 are loosened that the movable top drive roller bracket 120 may be adjusted upwardly and downwardly, by means of the hand knob 126, to position the top drive roller 80 in any desired adjusted position, after which the screws 135 and 142 are tightened to lock the top drive rollers 80 in said position.

As shown in FIG. 4, the right end of the lower drive roller shaft 82 is indicated by the numeral 146 and it is fixedly secured by any suitable means to a drive sprocket 147. A driven sprocket 149 is fixed, by any suitable means, to the outer end 148 of the upper drive roller shaft 136.

As shown in FIG. 1, a pair of horizontally disposed, longitudinally spaced apart idler sprockets 150 are rotatably mounted on a transversely disposed tubular bar 155. As shown in FIG. 4, each of the idler sprockets 150 is operatively mounted on a horizontal shaft 151 and secured thereto by a suitable nut 152. Each of the shafts 151 is provided with an enlarged shaft head 153. The outer wall of the tubular bar 155 is provided with a longitudinal slot 154 in which each of the shafts 151 is mounted. The shaft heads 153 retain said shafts in sliding engagement with the tubular bar 155 in the slots 154 for adjustment longitudinally of the bar 155. As shown in FIG. 4, the tubular bar 155 is secured by suitable machine screws 145 to the outer face of a longitudinally extended flange 156 of a mounting bracket which has an integral, transverse flange 157 that is secured to the upper rear face of the vertical plate 19 by suitable machine screws 158.

As best seen in FIG. 3, an endless drive chain 159 is operatively mounted around the drive sprocket 147, the driven sprocket 149 and the two idler sprockets 150. The numeral **149*a* in FIG. 3 indicates the adjusted upward position of the idler sprocket 149** when the machine is adjusted to assemble a larger diameter pipe than that shown.

As shown in FIGS. 1 and 2, the piper snapper machine 10 is provided with an exit or discharge pipe guide, generally indicated by the numeral 160, which is structurally identical to the entrance pipe guide 70. Accordingly, the various parts of the discharge pipe guide 160 which are the same as the parts for the pipe guide 10 have been marked with identical part numbers, followed by the small letter "a".

Figure 7:
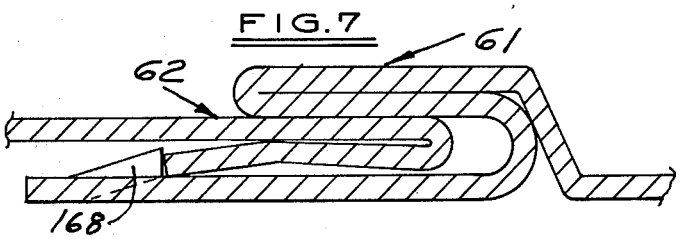
FIG. 7 is an enlarged, elevation section view of the pipe joint structure shown in the pipe illustration of FIG. 6.
Figure 8:
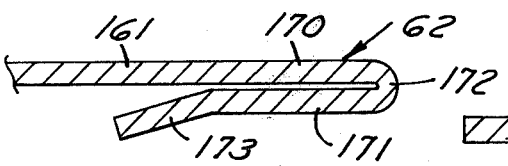
FIG. 8 is an enlarged, elevation section view of the male lock portion of the pipe joint structure illustrated in FIG. 7.
Figure 9:
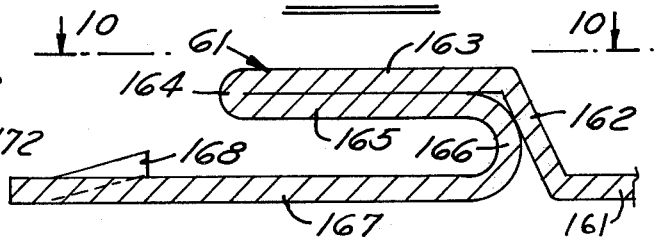
FIG. 9 is an enlarged, elevation section view of the female lock portion of the pipe joint structure illustrated in FIG. 7.
Figure 10:
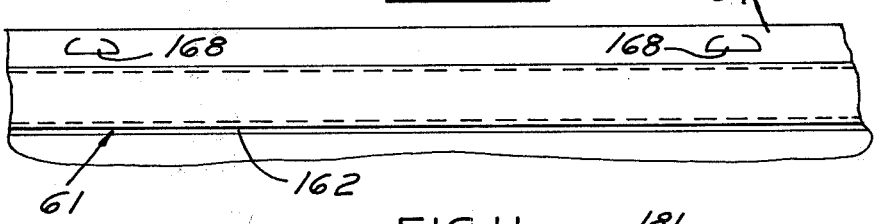
FIG. 10 is a fragmentary, top plan view of the female lock portion illustrated in FIG. 9, taken along the line 10—10 thereof, and looking in the direction of the arrows.

FIGS. 7, 8, 9 and 10 illustrate in detail the pipe joint structure shown in the pipe illustration of FIG. 6. The rectangular body of the pipe blank is indicated by the numeral 161, and the female lock portion 61 and the male lock portion 62 of the pipe joint structure of FIG. 6 are integrally formed along the opposite rectangular edges of the rectangular pipe blank body portion 161. The pipe blank portion 161 is normally formed from a suitable sheet metal material. As shown in FIG. 9, the female lock portion 61 of the pipe joint structure comprises an integral, outwardly angled portion 162 which is integrally connected at its outer end with a horizontal portion 163. The pipe blank material then is folded over at 164 to form a second parallel lock portion 165 which is seated against the inner face of the parallel portion 163. A third parallel portion 167 is integrally connected by an integral U-shaped portion 166 which is seated against the inner face of the angled joint portion 162. The third parallel joint portion 167 is spaced alart from the portion 165, and it extends outwardly beyond the joint folded portion 164, and it is provided with a plurality of longitudinally spaced apart, outwardly extended projections or tangs 168.

The male lock portion 62 is illustrated in detail in FIG. 8, and it includes an extension portion 170 which is integrally connected by a U-shaped portion 172 to a second folded-in parallel portion 171 which is spaced apart slightly from the portion 170. Integrally connected to the inner end of the inwardly folded parallel portion 171 is an angled lip portion 173 which is angled away from the pipe blank body 161 toward the inside of the pipe to be formed from the blank 161.

Figure 11:
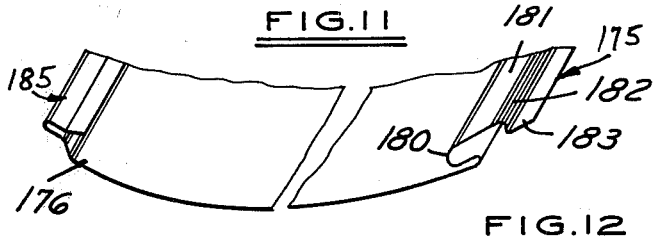
FIG. 11 is a fragmentary, broken, perspective view of a second pipe blank which may have its joint ends snapped together by the pipe snapper machine of the present invention.

In use, the pipe snapper machine 10 is placed in a desired position and secured in place, and the switch part 117 is operated to start rotation of the drive rollers 80 and 81. As shown in the drawings, the idler rollers 28 and 32, and the drive rollers 80 and 81 are positioned for operating on a predetermined size pipe, as for example, a 3" diameter pipe. It will be understood that the idler rollers 28 and 32, and the drive rollers 80 and 81 may be adjusted to a larger spaced apart condition for operating on a larger pipe, as for example, for the operation on a 4" pipe. It will also be understood, that the pipe snapper machine 10 of the present invention may be made to any desired size so as to handle any desired size pipe. The pipe blank 60 is either flat or rounded in cross section before being assembled, as illustrated in FIG. 11.

The operator initiates the assembly operation by grasping a pipe blank 60 and manually engaging one end of the male lock portion 62 in the female lock portion 61, as shown in FIG. 6, to start the snapping of these two lock portions together to form a pipe joint. With the pipe workpiece 60 resting on the entrance pipe guide 70 the operator guides the end of the pipe on which he has initiated the start of the joint forming action into the machine between the idler rollers 28 and 32. The operator continues pushing the pipe blank 60 into the machine between the guide shoes 63 until the leading end of the pipe blank 60 is engaged by the drive rollers 80 and 81, whereby the pipe blank is then grasped by the drive rollers 80 and 81, and pulled through the machine 10. The idler rollers 28 and 32 create a vertical pressure on the pipe blank 70; that is, the top idler roller 32 creates a downward squeezing pressure on the pipe blank 60 due to its canted position. The drive rollers 80 and 81 create a sideward pressure and squeeze the pipe blank 60 from the side to continue the snapping of the male lock portion 62 into the female lock portion 61 as the pipe blank 60 is drawn through the machine. The drive rollers 80 and 81 continue the sideward pressure on the blank 60 until it discharges the completely assembled pipe **60*a* onto the discharge pipe guard 160. As shown in FIG. 3, the sideward pressure on the pipe blank 60 creates a sideward snapping action on the pipe blank 60, and it is produced by the particular shape of the drive rollers 80 and 81. They are not formed with perfect semi-circular shapes. For example, the concave workpiece engaging surface of each of the drive rollers 80 and 81 would each be approximately 1/16 of an inch below the shape for a perfect semicircle, which would make a total of approximately $\frac{1}{8}$ of an inch out of round from a perfect semi-circle, as between the two rollers 80 and 81**.

It will be seen that the pipe snapper machine of the present invention assembles a sheet metal pipe blank or workpiece to produce a finished pipe product without deforming the metal of the pipe blank to produce a pipe joint. The machine of the present invention depends on the spring action of the pipe blank 60, tohether with the construction of the male and female lock portions 60 and 61 for snapping the two lock portions together to form an efficient and economical pipe joint.

The machine of the present invention thus provides a novel method of assembling a pipe blank into a finished and useful pipe by snapping together a male and female lock portion of a joint structure. The pipe snapper machine 10 of the present invention may be used at the same location where the pipe blanks 60 are manufactured, or at a distant location from the manufacturing source. For example, the pipe blanks 60 may be shipped in a stacked arrangement, in suitable containers, to the point of use, where they can then be assembled into complete pipes. This feature is advantageous since it reduces the shipping volume necessary to ship the pipes if they had to be shipped in their complete form, and accordingly, reduces the shipping costs. It will be seen that when the male lock structure 62 is snapped sidewardly into the female lock structure 61 that the lip flange 173 will be pushed into the space between the female parallel portions 165 and 167 so that the lip flange 173 of the male lock portion will be moved inwardly of the tangs 168. Thereafter, the inherent spring action in the pipe blank 60 will cause the lip flange 173 to be moved backwardly against the tangs 168, as shown in FIG. 7.

Figure 12:
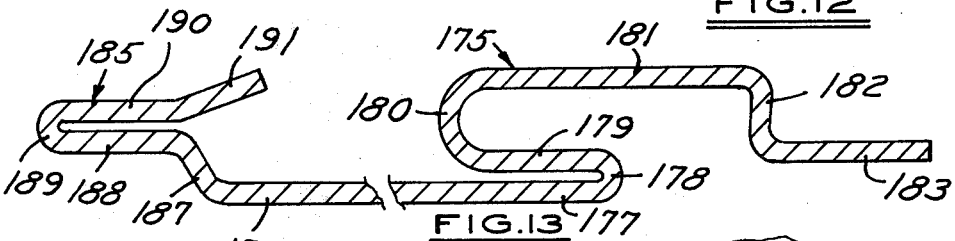
FIG. 12 is a broken, elevation section view of the pipe blank structure shown in FIG. 11, and showing the male and female lock portions of the pipe joint structure in enlarged forms.

FIGS. 11 and 12 illustrate the details of a second pipe blank and joint structure which may have its joint ends snapped together by the pipe snapper machine 10 of the present invention. The numerals 175 and 185 each generally designate the female and male lock portions of the pipe joint structure of the pipe blank illustrated in FIGS. 11 and 12. The rounded, rectangular body of the pipe blank of FIGS. 11 and 12 is designated by the numeral 176.

As shown in FIG. 12, the female joint lock portion 175 includes two integral, parallel portions 177 and 179 which are slightly spaced apart and joined by a U-shaped portion 178. The parallel part 179 is folded back over the parallel portion 177. The parallel portion 179 is spaced apart from a third parallel portion 181 to form a socket for the male lock portion 185. The female parallel lock portions 179 and 181 are connected by an integral U-shaped portion 180. An integral right angled lock portion 182 is attached to the outer end of the female parallel portion 181, and it is disposed opposite the U-shaped portion 181 so as to form a stop flange. Integrally formed at the other end of the stop flange member 182 is an outwardly extended flange 183 which is substantially parallel and aligned with the parallel lock portion 179.

The male joint lock portion 185 includes an integral, angled portion 187 which is integral at one end with the pipe blank body 176. Integrally attached to the outer end of the angled portion 187 is a flange portion 188 which is spaced apart from another parallel flange portion 190. The parallel flange portions 188 and 190 are integrally connected by a U-shaped portion 189. Integrally formed on the free end of the parallel flange portion 190 is an angled lip flange 191.

It will be seen that when the male joint lock portion 185 is moved in a clockwise direction, as viewed in FIG. 12, and the female joint portion 175 is moved in a counterclockwise direction, as viewed in FIG. 12, that the parallel flange portions 188 and 190 of the male joint lock portion 185 will be snapped into position in the pocket formed in the female joint lock portion 175. The spring action of the sheet metal that forms the pipe blank body 176 will move the retainer lip or flange 191 in an outwardly direction to position it against the inner face of the flange member 182 of the female joint lock portion 175.

Figure 13:
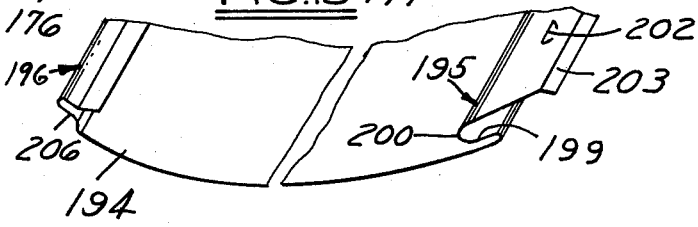
FIG. 13 is a fragmentary, broken, perspective view of a third pipe blank structure which may have its ends snapped together by the pipe snapper machine of the present invention.
Figure 14:
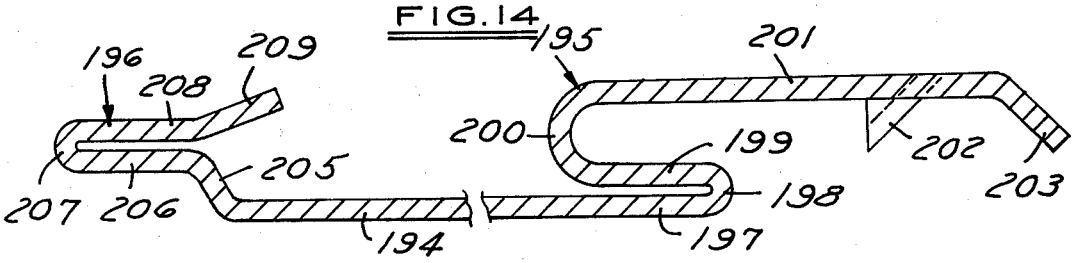
FIG. 14 is a broken, elevation section view of the pipe blank structure illustrated in FIG. 13, and showing the male and female lock portions of the joint structure in enlarged forms.

FIGS. 13 and 14 illustrate the details of a third pipe blank structure which may have its joint ends snapped together by the pipe snapper machine 10 of the present invention. The numerals 195 and 196 each generally designate the female and male lock portions of the pipe joint structure of the pipe blank illustrated in FIGS. 13 and 14. The rounded, rectangular body of the pipe blank of FIGS. 13 and 14 is designated by the numeral 194. As shown in FIG. 14, the female joint lock portion 195 includes two integral, parallel portions 197 and 199 which are slightly spaced apart and joined by a U-shaped portion 198. The parallel portion 199 is folded back over the parallel portion 197. The parallel portion 199 is spaced apart from a third parallel portion 201 to form a socket for the male joint lock portion 196. The female parallel lock portions 199 and 201 are connected by an integral U-shaped portion 200. The parallel portion 201 extends outwardly beyond the portion 199 and has a plurality of inwardly extended tangs or projections 202 which are longitudinally spaced apart over a length of the pipe blank 194 in a manner similar to the tangs 168 of the joint structure of FIGS. 7 through 10. An inwardly angled retainer lip flange 203 is integrally formed along the outer end of the parallel portion 201 at an angle of about 45° relative to the plane of the parallel portion 201. The male lock joint portion 196 is formed identical to the male lock joint portion 185 of the embodiment of FIGS. 11 and 12. The male joint lock portion 195 includes an integral angled portion 205 which is integral at one end with the pipe blank body 194. Integrally attached to the outer end of the angled portion 205 is a parallel flange portion 206 which is spaced apart from another parallel flange portion 208. The parallel flange portions 206 and 208 are integrally connected by a U-shaped portion 207. Integrally formed on the free end of the parallel flange portion 208 is an angled lip flange 209.

It will be seen that when the male lock joint portion 196 is moved in a clockwise direction, as viewed in FIG. 14, and the female lock joint portion 195 is moved in a counterclockwise direction, as viewed in FIG. 14, that the parallel flange portions 206 and 208 of the male lock joint portion 196 will be snapped into position in the pocket formed in the female lock joint portion 195. The spring action of the sheet metal that forms the pipe blank body 194 will move the retainer lip or flange 209 in an outward direction to position it against the inner faces of the tangs 202 of the female lock joint portion 195.

While it will be apparent that the preferred embodiment of the invention herein disclosed is well calculated to achieve the results aforestated, it will be appreciated that the invention is susceptible to modification, variation and change.

I claim:

1. In a pipe assembly machine for assembling a finished pipe from a rectangular pipe blank having either a flat or rounded cross section and having a male lock joint member along one longitudinal edge and a female lock joint member along the other longitudinal edge, the combination comprising:

(a) a base member;

(b) a vertical support member on said base member having a front side and a rear side, and a pipe passage formed therethrough;

(c) a pair of spaced apart idler rollers on the front side of said vertical support member for receiving the hand elastically folded and hand assembled leading end of a pipe blank therebetween and exerting pressure on one axis on the pipe blank perpendicular to a plane through the assembled lock joint members; and, (d) a pair of spaced apart power driven rollers on the rear side of said vertical support member for engaging said leading end of said pipe blank and pulling the pipe blank between the driven rollers and exerting pressure on another axis on the pipe blank perpendicular to the axis of pressure exerted by the idler rollers so as to assemble the male and female lock joint members together.

2. A pipe assembly machine as defined in claim 1, including:

(a) a pipe entrance guide means.

3. A pipe assembly machine as defined in claim 2, including:

(a) a pipe exit guide means.

4. A pipe assembly machine as defined in claim 3, wherein:

(a) said idler rollers are vertically spaced apart, and the bottom idler roller is mounted on the vertical support member in a stationary manner, and the top idler roller is adjustably mounted on the vertical support member.

5. A pipe assembly machine as defined in claim 4, wherein:

(a) said bottom idler roller is mounted for rotation on a horizontal axis, said top idler roller is mounted for rotation on an axis canted to the axis of rotation of said bottom idler roller.

6. A pipe assembly machine as defined in claim 5, wherein:

(a) each of said idler rollers has a semi-circular recess around the periphery thereof for engagement with a pipe blank.

7. A pipe assembly machine as defined in claim 6, wherein:

(a) said driven rollers are vertically spaced apart, and the bottom idler roller is mounted on the vertical support member in a stationary manner, and the top driven roller is adjustably mounted on the vertical support member.

8. A pipe assembly machine as defined in claim 7, wherein:

(a) said driven rollers are mounted for rotation on parallel, spaced apart horizontal axes.

9. A pipe assembly machine as defined in claim 8, wherein:

(a) each of said driven rollers has an eliptical recess formed around the periphery thereof for engagement with a pipe blank.

10. A pipe assembly machine as defined in claim 9, wherein:

(a) said idler rollers exert pressure on the pipe blank along a vertical axis, and said driven rollers exert pressure on the pipe blank along a horizontal axis.

11. A pipe assembly machine as defined in claim 2, including:

(a) power means operatively connected to said driven rollers for driving the driven rollers.

12. A pipe assembly machine as defined in claim 11, including:

(a) pipe guide means adjustably mounted on said vertical support member between said idler rollers and said driven rollers and extended through the pipe passage formed through said vertical support member.

13. A pipe assembly machine as defined in claim 4, including:

(a) means for adjusting the top idler roller and the top driven roller on the vertical support member.

14. A method for assembling sheet metal pipes from a preformed pipe blank having a male lock joint member along one longitudinal edge, and a female lock joint member along the other longitudinal edge, comprising the steps of:

(a) manually elastically folding a leading end of the pipe blank so as to move the longitudinal edges toward each other;

(b) manually inserting the leading end of the male lock joint member into the female lock joint member on a vertical plane;

(c) encircling the leading end of the pipe blank with a first pair of rollers which are disposed on nonparallel axes to exert pressure on the pipe blank on a vertical plane; and, (d) moving the leading edge of the pipe beyond the first pair of rollers and between a second pair of rollers which are disposed on parallel axes to exert a pressure on the pipe blank on a horizontal plane and effect the assembly of the male lock joint into the female lock joint as the pipe blank is moved through the second pair of rollers.

* * * * *